US005304106A

United States Patent [19]

Gresko

[11] Patent Number: 5,304,106

[45] Date of Patent: Apr. 19, 1994

[54] EXERCISE APPARATUS HAVING RECIPROCATING PLATFORMS MOVABLE BETWEEN A PARALLEL POSITION AND AN OPPOSED POSITION

[75] Inventor: James D. Gresko, Rochester, N.Y.

[73] Assignee: Voit Sports, Incorporated, Fairport, N.Y.

[21] Appl. No.: 14,647

[22] Filed: Feb. 8, 1993

[51] Int. Cl.[5] ..... A63B 22/04; A63B 23/08

[52] U.S. Cl. ..... 482/53; 482/80

[58] Field of Search ..... 482/51, 52, 53, 19, 482/27, 28, 29, 79, 80, 146, 147, 908

[56] References Cited

U.S. PATENT DOCUMENTS

| | | | |
|---|---|---|---|
| 3,598,404 | 8/1971 | Bowman | 482/80 |
| 3,756,595 | 9/1973 | Hague | 482/51 |
| 4,159,111 | 6/1979 | Lowth | 482/80 |
| 4,998,720 | 3/1991 | Kim | 482/79 |

FOREIGN PATENT DOCUMENTS 2510049 9/1975 Fed. Rep. of Germany .

*Primary Examiner*—Stephen R. Crow

*Attorney, Agent, or Firm*—Cumpston & Shaw

[57] ABSTRACT

An exercise apparatus for simulating a stepping motion, wherein the horizontal components of the stepping motion may be either parallel, or opposed. The apparatus includes a first and second stepper mechanism connected by a central pivot. Each stepper mechanism includes a mechanism for yieldably resisting downward motion of a foot platform. The central pivot allows the stepper mechanisms may be aligned in a parallel orientation, wherein the horizontal component of motion of each foot platform is parallel. Alternatively, the central pivot permits orientation of the stepper mechanisms in an opposed or end-to-end relation, wherein the horizontal component of motion of each foot platform is colinear and opposed.

8 Claims, 3 Drawing Sheets

EXERCISE APPARATUS HAVING RECIPROCATING PLATFORMS MOVABLE BETWEEN A PARALLEL POSITION AND AN OPPOSED POSITION

BACKGROUND OF THE INVENTION

The present invention relates to exercise equipment, and more particularly, to an exercise machine for simulating a stepping motion, wherein the horizontal component of the stepping motion for each foot may be in a side-by-side parallel orientation or an opposed orientation.

The prior art includes a number of mechanisms for simulating stepping or stair climbing activities. Specifically, U.S. Pat. No. 5,139,470 discloses an exerciser having a pair of treadles pivotally coupled to a frame, wherein each treadle is associated with a hydraulic cylinder and each cylinder is coupled to a valve to provide control of the hydraulic fluid between the cylinders so that the resistance of the cylinders may be varied, thereby adjusting the relative resistance to motion of the treadles.

U.S. Pat. No. 3,756,595 discloses a leg exercising device for simulating ice skating. The ice skating simulator provides motion of the feet to define either a linear path, or alternatively a curvilinear path.

U.S. Pat. No. 3,598,404 discloses a calf exercising apparatus having a pair of independently adjustable inclined platforms, wherein the platforms are interconnected by a central bearing point.

SUMMARY OF THE INVENTION

The present invention provides an exercise apparatus for simulating a linear stepping motion or an opposed, rocking motion.

Specifically, the exercise apparatus of the present invention includes first and second stepper mechanisms, and a central pivot connecting the first stepper mechanism to the second stepper mechanism. Each stepper mechanism includes a foot platform and means for yielding resisting downward motion of the foot platform. The central pivot permits the foot platforms to be moved from a first side-by-side position for simulating linear walking wherein the horizontal components of motion are parallel to a second end-to-end configuration providing a rocking motion wherein the horizontal components of motion are opposed.

DETAILED DESCRIPTION OF THE PREFERRED EMBODIMENT

Figure 1:
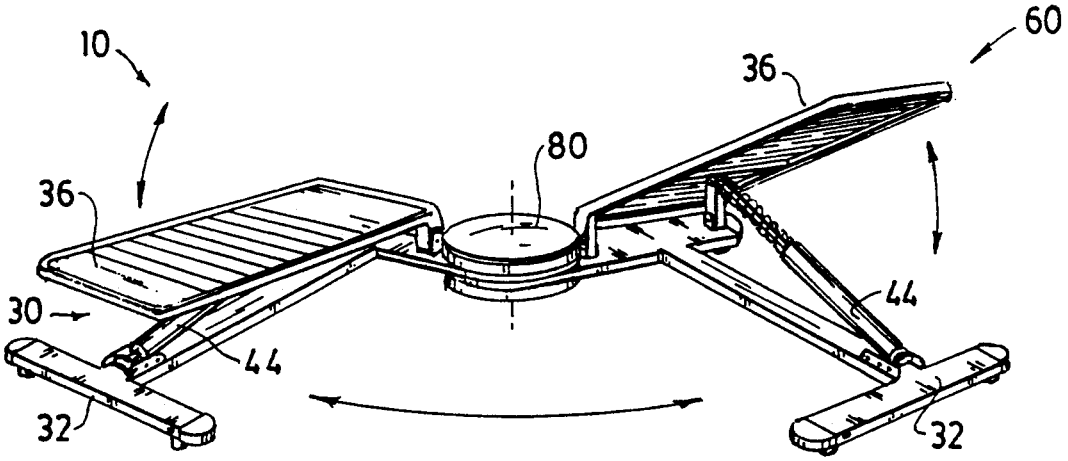
FIG. 1 is a perspective view of the present invention showing the relative motion of each independent stepper mechanism and movement of the stepper mechanisms about a central pivot.
Figure 2:
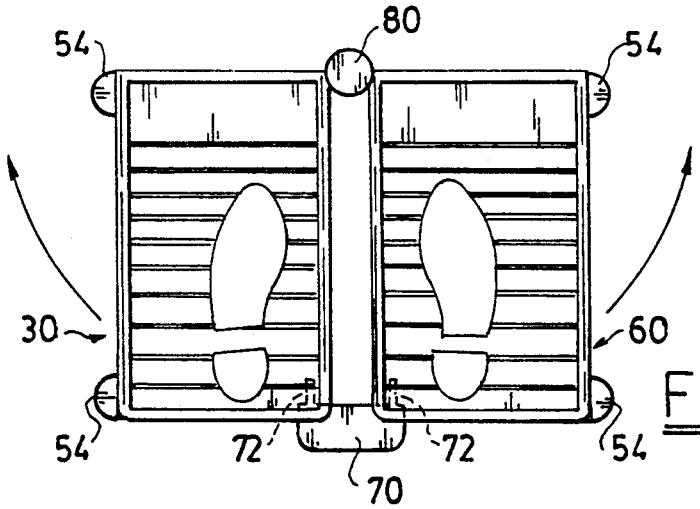
FIG. 2 is a top plan view showing the stepper mechanisms in a first side-by-side position.
Figure 3:
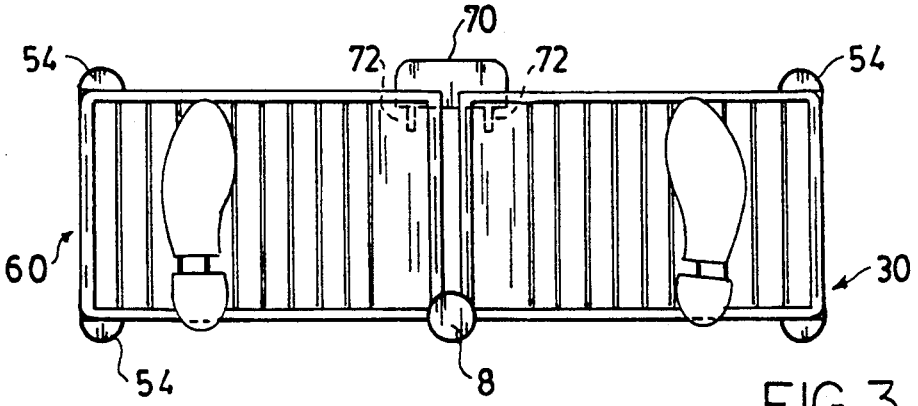
FIG. 3 is a top plan view showing the stepper mechanisms in a second opposed position.

Referring to FIG. 1, the exercise apparatus 10 includes a first stepper mechanism 30, a second stepper mechanism 60 and a central pivot 80. As shown in FIGS. 1-3, the central pivot 80 permits the first and second stepper mechanisms 30,60 to be moved from a first side-by-side position (FIG. 2) to a second opposed end-to-end position (FIG. 3).

Figure 4:
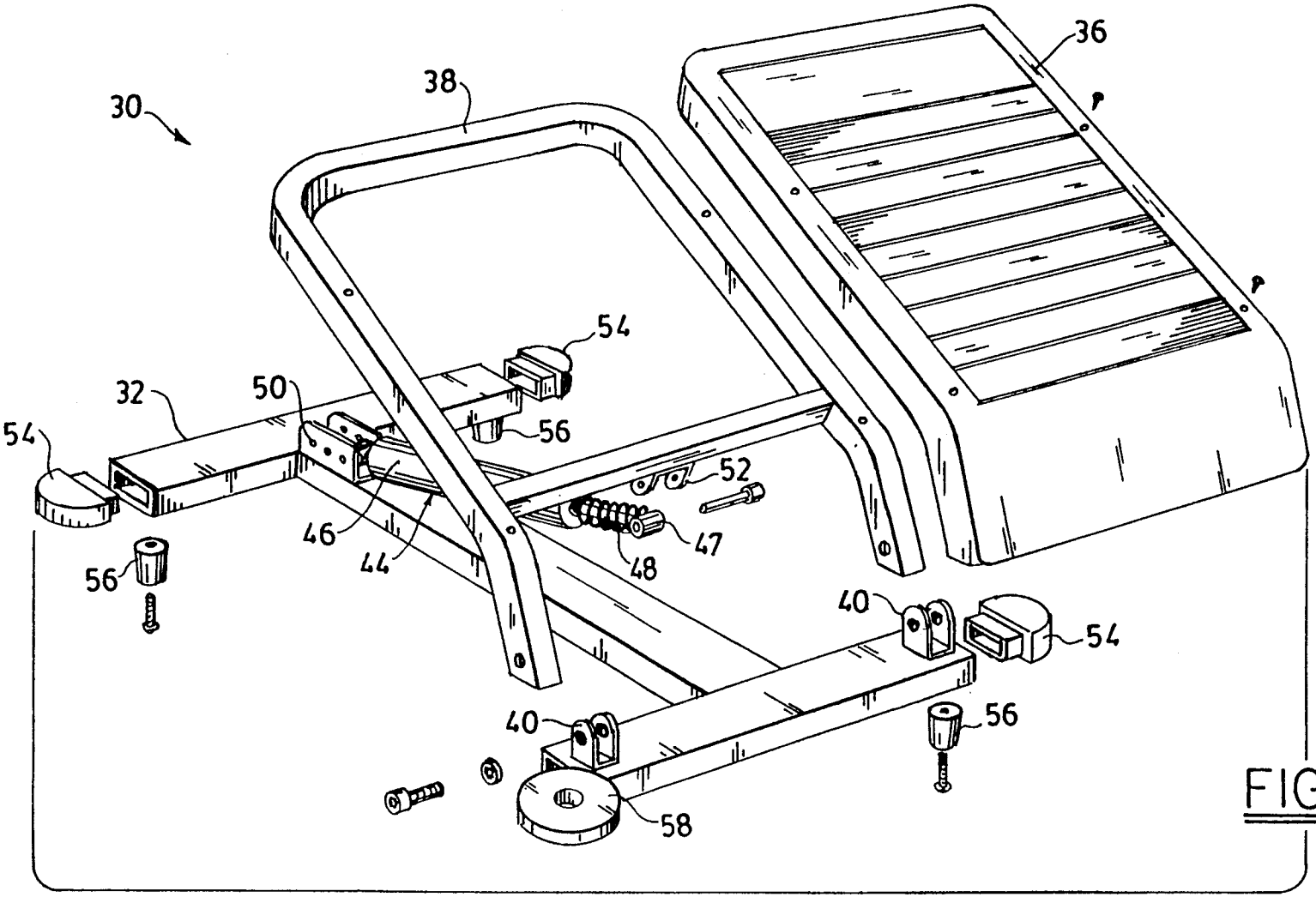
FIG. 4 is an exploded view of a stepper mechanism.

Referring to FIG. 4, the exploded components of the first stepper mechanism 30 are shown. As the second stepper mechanism 60 is a mirror image of the first stepper mechanism 30, only the first stepper mechanism will be described in detail, with the understanding that the mirror image changes are necessary.

The first stepper mechanism 30 includes a base 32. The base 32 contacts a supporting surface and is pivotally connected to the central pivot 80 by offset pivot arm 58. As shown in FIG. 4, the base 32 includes end caps 54 to reduce sharp edges. In addition, the base 32 may include depending feet 56 affixed to the bottom of the base. The base 32 may be formed of metal, wood or rigid plastic and includes a parallel locking recess 33 and an opposed locking recess 35 as shown in FIGS. 1 and 3. The base 32 also includes pedal pivots 40 and adjusting bracket 50.

Foot platform 36 is pivotally affixed to the base 32 by platform frame 38. The platform frame 38 is pivotally attached to the base 32 at pedal pivots 40. The platform frame 38 includes a depending pivot bracket 52 and is preferably formed of substantially tubular steel or other rigid material. The foot platform 36 may be formed of a thermosetting or thermoplastic material, or alternatively may be formed of a stamped or cast metal. The foot platform 36 includes a tread pattern for improving frictional resistance between the user and the foot platform. The platform frame 38 and foot platform 36 may be formed as a integral unit or alternatively as two separate components as shown in FIG. 4. In either case, the foot platform 36 and platform frame 38 move as a single component.

The pivotal attachment of one end of the foot platform 36 to the base 32 results in the foot platform defining an arcuate travel path. That is, the portion of the foot platform 36 nearest the pedal pivots 40 moves through a relatively short arcuate path as compared to the longer arcuate path traced by the end of the foot platform which is remote from the pedal pivots. Therefore, the motion of each foot platform 36 includes a horizontal component and a vertical component which together define the arcuate path of the foot pedal.

A yieldable resistance mechanism 44 extends between the base 32 and the platform frame 38. The resistance mechanism 44 includes a hydraulic cylinder 46 and coil spring 48. The hydraulic cylinder 46 is connected at one end to the base 32 at the adjusting bracket 50. The remaining end of the hydraulic cylinder 46 is pivotally affixed to the platform frame 38 at the pivot bracket 52. The hydraulic cylinder 46 includes an extendable piston 47 which is pivotally connected to the platform frame 38 at the pivot bracket 52. Motion of the piston 47 into the hydraulic cylinder 46 acts against a fluid resistance thereby yieldably resisting downward motion of the foot platform. As the piston 47 is forced into the hydraulic cylinder 46 the length of the resistance mechanism is reduced and the foot platform 36 is lowered against the restricted flow of fluid in the cylinder.

The coiled spring 48 is concentrically retained on the piston 47. The spring 48 assists in resisting downward motion of the foot platform 36 and urges the foot platform toward the normal default upper position.

Alternatively, the mechanism 44 for yieldably resisting downward motion of the foot platforms 36 may include elastomeric components such as bands or chords. The action of the bands or chords are preferably dampened to prevent sudden acceleration of the foot platforms 36. A pneumatic system may also be used to yieldably resist downward motion. In fact, any mechanical or electromechanical device may be used to resist motion of the foot platforms 36.

Therefore, the foot platform 36 of each stepper mechanism is movable between an upper and a lower position, wherein the resistance mechanism 44 yieldably resists motion of a foot platform from the upper position to the lower position. In addition, upon release of the downward force on the foot platform 36, the resistance mechanism 44 returns the foot platform from lower position to the upper position for yieldably resisting downward motion of the foot platform.

With respect to the second stepper mechanism 60, the off set pivot arm, parallel locking recesses and oppose locking recesses and mirror images of their respective location on the first stepper mechanism 30.

Referring to FIGS. 1–3, 5 and 6, the first stepper mechanism 30 is pivotally attached to the second stepper mechanism 60 to permit the stepper mechanisms to be oriented between a first parallel position and a second opposed position.

As shown in FIG. 2, in the parallel position, a lock block 70 having protruding spaced apart tabs 72 engages the first stepper mechanism 30 and the second stepper mechanism 60. Specifically, a tab 72 is received within the parallel locking recesses 33 of the first stepper mechanism 30 and the remaining tab 72 of the lock block 70 is received within the parallel locking recess of the second stepper mechanism 60 to retain the stepper mechanisms in a parallel orientation.

Figure 6:
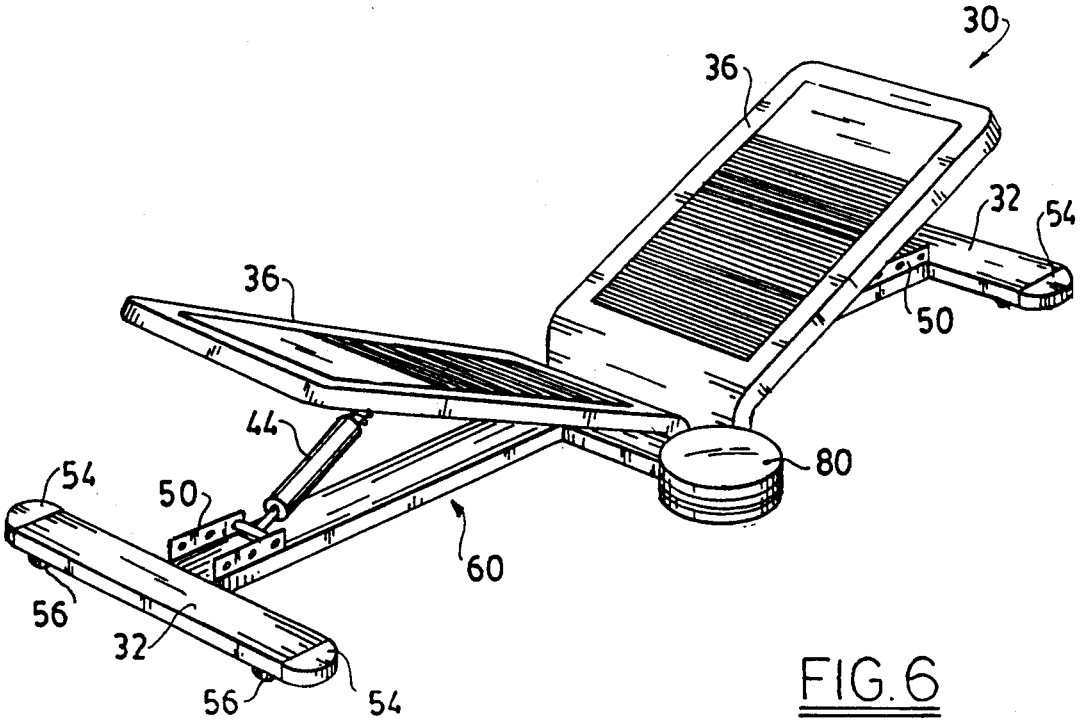
FIG. 6 is a perspective view of the stepper mechanisms in the second opposed position as shown in FIG. 3.

Referring to FIGS. 3 and 6, upon orientation of the stepper mechanisms 30,60, in an opposing, end-to-end position, one tab 72 of the lock block 70 is received in the opposed locking recess of the first stepper mechanism 30 and the remaining tab 72 of the lock block 70 is received within the opposed locking recess of the second stepper mechanism 60, thereby retaining the stepper mechanisms in the opposed positions.

OPERATION

Figure 5:
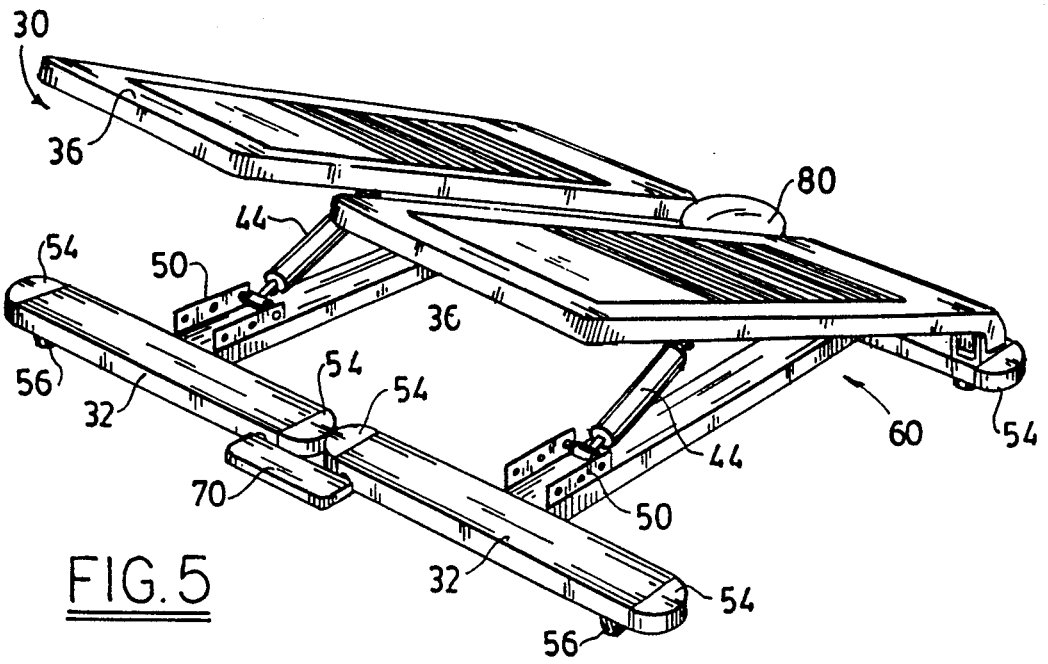
FIG. 5 is a perspective view of the stepper mechanisms in the first position as shown in FIG. 2.

Referring to FIG. 2, upon operably securing the exercise apparatus 10 with the stepper mechanisms 30,60 in the parallel orientation, the user places one foot upon each foot platform 36 such that the toes are directed towards the pivotal connection of the foot platform and the base 32. The stepping motion is simulated by the user shifting weight between the right foot and the left foot by bending the knee in a forward, or walking motion. Referring to FIGS. 1, 2 and 5, upon orientation of the stepper mechanisms 30,60 in the parallel orientation, the horizontal component of motion of the foot platforms 36 is parallel. That is, the arcuate paths defined by the free end of the foot platforms 36 are parallel.

Alternatively, the stepper mechanisms 30,60 may be oriented in end-to-end opposed position shown in FIG. 3. In the end-to-end position, the user again places one foot on each stepper mechanism 30,60. However, in this orientation, the longitudinal axis of the foot is substantially parallel to the pivotal connection of the foot platform 36 and the base 32. The user again alternates weight between the left and the right foot. In this instance, the weight is shifted by raising the knee and upper portion of the leg in a rocking or waddling motion.

Upon orientation of the stepper mechanisms 30,60 in the opposed, or end to end position as shown in FIG. 3, the horizontal component of the motion of each foot platform 36 is directed toward the opposing platform upon upward motion of the pedal. That is, in the opposed relationship, the horizontal motions of the stepper mechanisms 30,36 are opposed to each other, in contrast to the parallel and same direction of the horizontal components when the stepper mechanisms are in the parallel position. The arcuate paths traced by the foot platforms 36 in the end-to-end position intersect.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed:

1. A stepper exercise apparatus for simulating a stepping action, comprising:

(a) first stepper means movable between an upper position and a lower position for yieldably resisting motion from the upper position to the lower position;

(b) second stepper means movable between an upper position and a lower position for yieldably resisting motion from the upper position to the lower position; and (c) pivot means interconnecting the first and the second stepper means for orienting the first and the second stepper means in a first substantially parallel relationship and a second substantially opposed relationship.

2. The stepper exercise apparatus of claim 1, wherein the first stepper means includes a base and a foot platform pivotally attached to the base, and the second stepper means includes a base and a foot platform pivotally attached to the base.

3. A stepper exercise apparatus, comprising:

(a) first and second stepper platforms providing reciprocating motion wherein the reciprocating motion includes a vertical component; and (b) pivotal connecting means connecting the first stepper platform to the second stepper platform for permitting the platforms to be moved from a first side by side configuration to a second end to end configuration.

4. An exercise apparatus for simulating a repeated stepping motion, comprising;

(a) a first stepper mechanism including a foot platform movable between an upper and a lower position;

(b) a second stepper mechanism including a foot platform movable between an upper and a lower position;

(c) resistance means connected to the first and the second stepper mechanisms for yieldably resisting downward motion of the foot platform; and (d) pivot means interconnecting the first stepper mechanism and the second stepper mechanism for orienting the stepper mechanisms in a first substantially side by side relationship and a second substantially opposed relationship.

5. The exercise apparatus of claim 4, wherein the stepper mechanism includes:

(a) a base for contacting a supporting surface, wherein the foot platform is pivotally connected to the base, and the resistance means extends between the base and the foot platform for resisting motion of the foot platform towards the base.

6. A stepper exercise apparatus, comprising:

(a) first and second stepper mechanisms, each stepper mechanism including a foot platform movable from an upper position to a lower position, wherein the motion of the foot platform includes a vertical component and a horizontal component;

(b) resistance means for yieldably resisting at least downward vertical motion of each foot platform; and (c) pivotal connecting means connecting the first stepper mechanism to the second stepper mechanism for permitting the foot platforms to be moved from a first side by side configuration wherein the horizontal component of motion of each stepper mechanism is parallel, and a second end to end configuration wherein the horizontal component of each stepper mechanism is colinear.

7. A stepper exercise apparatus, comprising:

(a) first and second stepper mechanisms each stepper mechanism including a movable foot platform wherein the motion of the foot platform includes a vertical component and a horizontal component;

(b) resistance means for yieldably resisting at least the vertical component of the motion of each foot platform; and (c) pivotal connecting means connecting the first stepper mechanism to the second stepper mechanism for permitting the foot platforms to be moved from a first side by side configuration wherein the horizontal component of motion of each stepper mechanism is parallel and a second end to end configuration wherein upon downward vertical motion is away from the remaining each stepper mechanism.

8. A stepper exercise apparatus, comprising:

(a) first and second stepper mechanisms, each stepper mechanism including a movable foot platform wherein the motion of the foot platform includes a vertical component and a horizontal component;

(b) resistance means for resisting at least the vertical component of the motion of each foot platform; and (c) pivotal connecting means connecting the first stepper mechanism to the second stepper mechanism for permitting the foot platforms to be moved from a first side by side position, wherein the horizontal components of motion of the foot platforms are substantially parallel to a second end to end position, wherein the horizontal component of motion of the foot platforms intersect.

* * * * *